US009093780B2

(12) United States Patent
Miyake

(10) Patent No.: US 9,093,780 B2
(45) Date of Patent: Jul. 28, 2015

(54) PRESS-FIT PIN, CONNECTION STRUCTURE INCLUDING THE PRESS-FIT PIN, AND ELECTRONIC DEVICE INCLUDING THE PRESS-FIT PIN

(71) Applicant: DENSO CORPORATION, Kariya, Aichi-pref. (JP)

(72) Inventor: Toshihiro Miyake, Inuyama (JP)

(73) Assignee: DENSO CORPORATION, Kariya (JP)

( * ) Notice: Subject to any disclaimer, the term of this patent is extended or adjusted under 35 U.S.C. 154(b) by 73 days.

(21) Appl. No.: 14/036,906

(22) Filed: Sep. 25, 2013

(65) Prior Publication Data

US 2014/0213080 A1 Jul. 31, 2014

(30) Foreign Application Priority Data

Jan. 30, 2013 (JP) ..... 2013-015319

(51) Int. Cl.
*H01R 12/58* (2011.01)
*H01R 13/03* (2006.01)

(52) U.S. Cl.
CPC ..... *H01R 12/585* (2013.01); *H01R 13/03* (2013.01)

(58) Field of Classification Search
CPC ..... H01R 12/585
USPC ..... 439/82
See application file for complete search history.

(56) References Cited

U.S. PATENT DOCUMENTS 4,066,326 A * 1/1978 Lovendusky ..... 439/873
4,206,964 A * 6/1980 Olsson ..... 439/873
4,655,537 A * 4/1987 Andrews, Jr. ..... 439/751
4,737,114 A * 4/1988 Yaegashi ..... 439/82
4,790,764 A * 12/1988 Kawaguchi et al. ..... 439/78
4,857,018 A * 8/1989 Pickles ..... 439/751
4,878,861 A * 11/1989 Kendall et al. ..... 439/751
4,897,053 A * 1/1990 Verhoeven et al. ..... 439/751
4,906,209 A * 3/1990 Tanabe et al. ..... 439/620.24
4,923,414 A * 5/1990 Sitzler ..... 439/751
4,997,379 A * 3/1991 Rozmus ..... 439/84
5,073,118 A * 12/1991 Grabbe et al. ..... 439/71
5,078,612 A * 1/1992 Rozmus ..... 439/84
5,564,954 A * 10/1996 Wurster ..... 439/751

(Continued)

FOREIGN PATENT DOCUMENTS

JP 2000-505590 A 5/2000
JP 2003-346951 A2 12/2003

(Continued)

OTHER PUBLICATIONS

Office Action issued Dec. 2, 2014 in corresponding JP Application No. 2013-015319 (with English translation).

*Primary Examiner* — Ross Gushi

(57) ABSTRACT

A tip end and a base end therebetween define an opening located between a first conductive portion and a second conductive portion. The opening includes a pair of first linear portions, a pair of second linear portions, and a pair of third linear portions, which are located between the first conductive portion and the second conductive portion. The pair of first linear portions is in straight liner shapes and distant from both the tip end and the base end. The second linear portions are in straight liner shapes and located on the side of the tip end to have therebetween a distance decreasing toward the tip end. The third linear portions are in straight liner shapes and located on the side of the base end to have therebetween a distance decreasing toward the base end.

3 Claims, 4 Drawing Sheets

(56) References Cited

U.S. PATENT DOCUMENTS

| | | | | |
|---|---|---|---|---|
| 5,664,970 | A * | 9/1997 | Millhimes et al. | 439/751 |
| 5,944,538 | A * | 8/1999 | Sorig | 439/82 |
| 5,944,563 | A * | 8/1999 | Nagafuji | 439/751 |
| 6,077,128 | A * | 6/2000 | Maag et al. | 439/751 |
| 6,213,817 | B1 * | 4/2001 | Jeong et al. | 439/751 |
| 6,305,949 | B1 * | 10/2001 | Okuyama et al. | 439/75 |
| 7,048,594 | B2 * | 5/2006 | Tsuchiya | 439/751 |
| 7,048,595 | B2 * | 5/2006 | Nakamura et al. | 439/751 |
| 7,377,823 | B2 * | 5/2008 | Chen | 439/751 |
| 7,491,897 | B2 * | 2/2009 | Watanabe et al. | 174/266 |
| 7,591,655 | B2 * | 9/2009 | Fedder et al. | 439/108 |
| 7,670,196 | B2 * | 3/2010 | Fedder et al. | 439/751 |
| 7,780,483 | B1 * | 8/2010 | Ravlich | 439/751 |
| 7,867,016 | B2 * | 1/2011 | Nabilek et al. | 439/474 |
| 7,922,545 | B2 * | 4/2011 | Saitoh | 439/751 |
| 8,002,559 | B2 * | 8/2011 | Thiel et al. | 439/82 |
| 8,579,638 | B2 * | 11/2013 | Schaarschmidt et al. | 439/82 |
| 8,628,361 | B2 * | 1/2014 | Kato | 439/751 |
| 8,771,028 | B2 * | 7/2014 | Tonosaki | 439/886 |
| 2003/0236009 | A1 * | 12/2003 | Tsuchiya | 439/82 |
| 2005/0176267 | A1 | 8/2005 | Saitoh | |
| 2005/0181651 | A1 * | 8/2005 | Matsumura | 439/259 |
| 2008/0318453 | A1 * | 12/2008 | Dancison | 439/82 |
| 2013/0165001 | A1 * | 6/2013 | Kataoka | 439/889 |
| 2014/0118973 | A1 * | 5/2014 | Nastasa et al. | 361/760 |
| 2014/0213080 | A1 * | 7/2014 | Miyake | 439/82 |
| 2014/0342619 | A1 * | 11/2014 | Uchida | 439/751 |

FOREIGN PATENT DOCUMENTS

| | | | |
|---|---|---|---|
| JP | 2005-071732 | A | 3/2005 |
| JP | 2005-226089 | A | 8/2005 |
| JP | 2006-114492 | A | 4/2006 |
| JP | 2006-152389 | A2 | 6/2006 |
| JP | 2008-053082 | A | 3/2008 |
| JP | 2009-021238 | A | 1/2009 |

* cited by examiner

FIG. 4
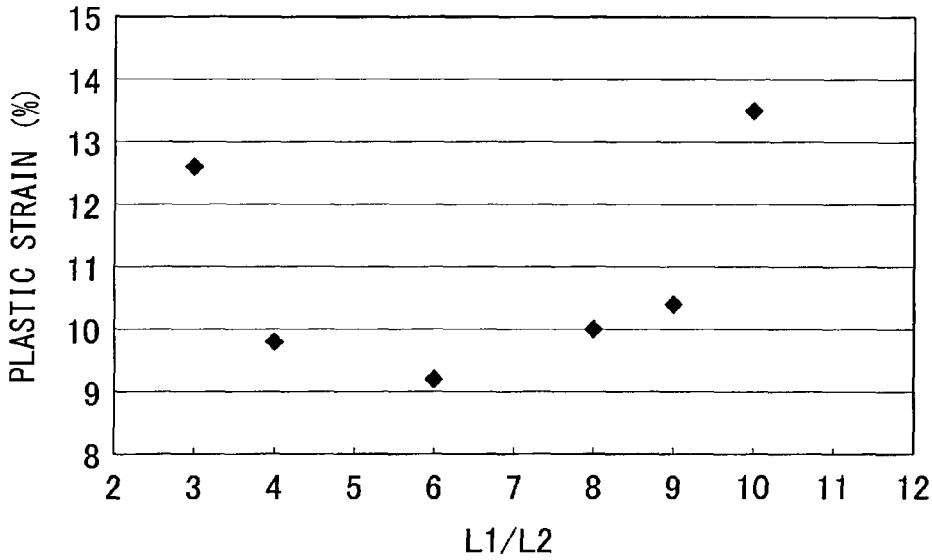
FIG. 5
| L1/L2 | 3 | 4 | 6 | 8 | 9 | 10 |
|---|---|---|---|---|---|---|
| Ni PLATE: 3 μm | × | × | × | × | × | × |
| Ni PLATE: 1. 0 μm | × | ○ | ○ | ○ | ○ | × |
| Ni PLATE: 0. 5 μm | × | ○ | ○ | ○ | ○ | × |
FIG. 6
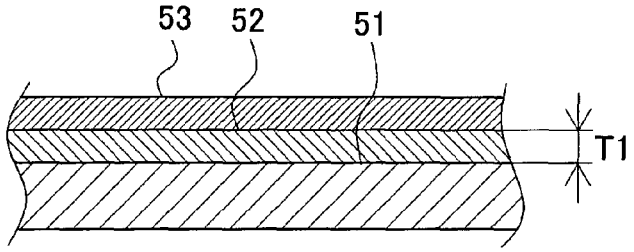

PRESS-FIT PIN, CONNECTION STRUCTURE INCLUDING THE PRESS-FIT PIN, AND ELECTRONIC DEVICE INCLUDING THE PRESS-FIT PIN

CROSS REFERENCE TO RELATED APPLICATION

This application is based on reference Japanese Patent Application No. 2013-15319 filed on Jan. 30, 2013, the disclosure of which is incorporated herein by reference.

TECHNICAL FIELD

The present disclosure relates to a press-fit pin, a connection structure including the press-fit pin, and an electronic device including the press-fit pin.

BACKGROUND

For example, a vehicular electronic component employs a connection structure, which includes a press-fit terminal inserted in a through hole, which is formed in a circuit board. In general, such a press-fit terminal has a center portion having an elongated opening. The center portion having the elongated opening has a largest width, which is set to be greater than a diameter of the through hole in which the press-fit terminal is attached. When the press-fit terminal is inserted in and attached to the through hole, both side portions of the press-fit terminal, which are on the outer side of the opening, urges the inner wall of the through hole. Thus, both the side portions apply a required contact force onto the inner wall of the through hole to form electric contacts. For example, Patent Document 1 discloses an art related to a press-fit terminal.

(Patent Document 1)

Publication of Unexamined Japanese Patent Application No. 2000-505590

A press-fit terminal is demanded to function as an electric contact stably. To function as an electric contact stably, a press-fit terminal desirably has a sufficient contact load to the through hole. In addition, in a configuration in which a large strain occurs in a press-fit terminal, the press-fit terminal may cause a crack. Therefore, a press-fit terminal desirably has a configuration to cause a small strain.

To the contrary, in the disclosure of Patent Document 1, the terminal has an opening (hole) in a curved ellipse shape. Therefore, in the configuration of Patent Document 1, the width of the terminal becomes small in a curve portion of an end of the opening. In particular, the width between an inner wall, which defines the opening, and each side portion of the terminal becomes small. In particular, the side of the tip end of the press-fit terminal is in a shape, in which the width decreases toward the tip end, in consideration to facilitate insertion of the terminal into the through hole, and/or the like. In the configuration of Patent Document 1, the opening has straight line portions (inner boundaries), which are in parallel with each other, extending to a position significantly close to a first end, which is in a curved semicircle shape. Therefore, in the configuration of Patent Document 1, the width between the inner wall of the opening and each tip end of the terminal may become small in a wide region close to the first end. Similarly, in the configuration of Patent Document 1, the terminal of the opening has straight line portions (inner boundaries), which are in parallel with each other, extending to a position significantly close to a second end, which is in a curved semicircle shape. Therefore, it is difficult to secure sufficiently the width between the inner wall of the opening and each tip end of the terminal in a wide region close to the second end. The press-fit terminal having such a configuration, in which the width is small around each end of the opening, may cause a large strain around each end of the opening when being inserted into the through hole. Consequently, the press-fit terminal may cause a crack due to concentration of the stress, and-or the like.

SUMMARY

It is an object of the present disclosure to produce a press-fit terminal configured to produce a sufficient contact load and to restrict a strain caused in the press-fit terminal.

According to an aspect of the present disclosure, a press-fit terminal is formed of an electricity conductive material and extended in a predetermined direction. The press-fit terminal comprises a tip end located on one side relative to the predetermined direction. The press-fit terminal further comprises a base end located on an other side relative to the predetermined direction. The press-fit terminal further comprises a first conductive portion extending from a side of the tip end toward the base end. The press-fit terminal further comprises a second conductive portion extending from a side of the tip end toward the base end. The second conductive portion is connected with the first conductive portion on the side of the tip end and on the side of the base end. The tip end and the base end therebetween define an opening, which is a through hole passing through a portion between the first conductive portion and the second conductive portion. The opening includes a pair of first linear portions, a pair of second linear portions, and a pair of third linear portions. The pair of first linear portions is in straight liner shapes extending in predetermined directions, respectively. The pair of first linear portions is defined by a sidewall portion of the first conductive portion and a sidewall portion of the second conductive portion. The pair of first linear portions is distant from both one end portion of the opening on the side of the tip end and an other end portion of the opening on the side of the base end. The pair of second linear portions is in straight liner shapes extending in inclined directions, respectively, relative to the predetermined direction. The pair of second linear portions is defined by the sidewall portion of the first conductive portion and the sidewall portion of the second conductive portion. The pair of second linear portions is located on a side of the one end portion relative to the pair of first linear portions. A distance between the pair of second linear portions decreases toward the one end portion. The pair of third linear portions is in straight liner shapes extending in inclined directions, respectively, relative to the predetermined direction. The pair of third linear portions is defined by the sidewall portion of the first conductive portion and the sidewall portion of the second conductive portion. The pair of third linear portions is located on a side of the other end portion relative to the pair of first linear portions. A distance between the pair of third linear portions decreases toward the other end portion.

BRIEF DESCRIPTION OF THE DRAWINGS

The above and other objects, features and advantages of the present invention will become more apparent from the following detailed description made with reference to the accompanying drawings. In the drawings:

FIG. 4 is a graph showing a relation between a plastic strain (%) and a ratio L1/L2, which a ratio between a length L1 of an opening of the press-fit terminal and a length L2 of a first linear portion of the opening;

FIG. 5 is a view showing an experimental result whether a crack occurs in the press-fit terminal in different conditions in which a thickness of nickel plating and the ratio L1/L2 are changed; and FIG. 6 is a view showing a configuration of plated layers formed on the surface of a base material of the press-fit terminal shown in FIG. 1.

DETAILED DESCRIPTION

First Embodiment

Figure 1:
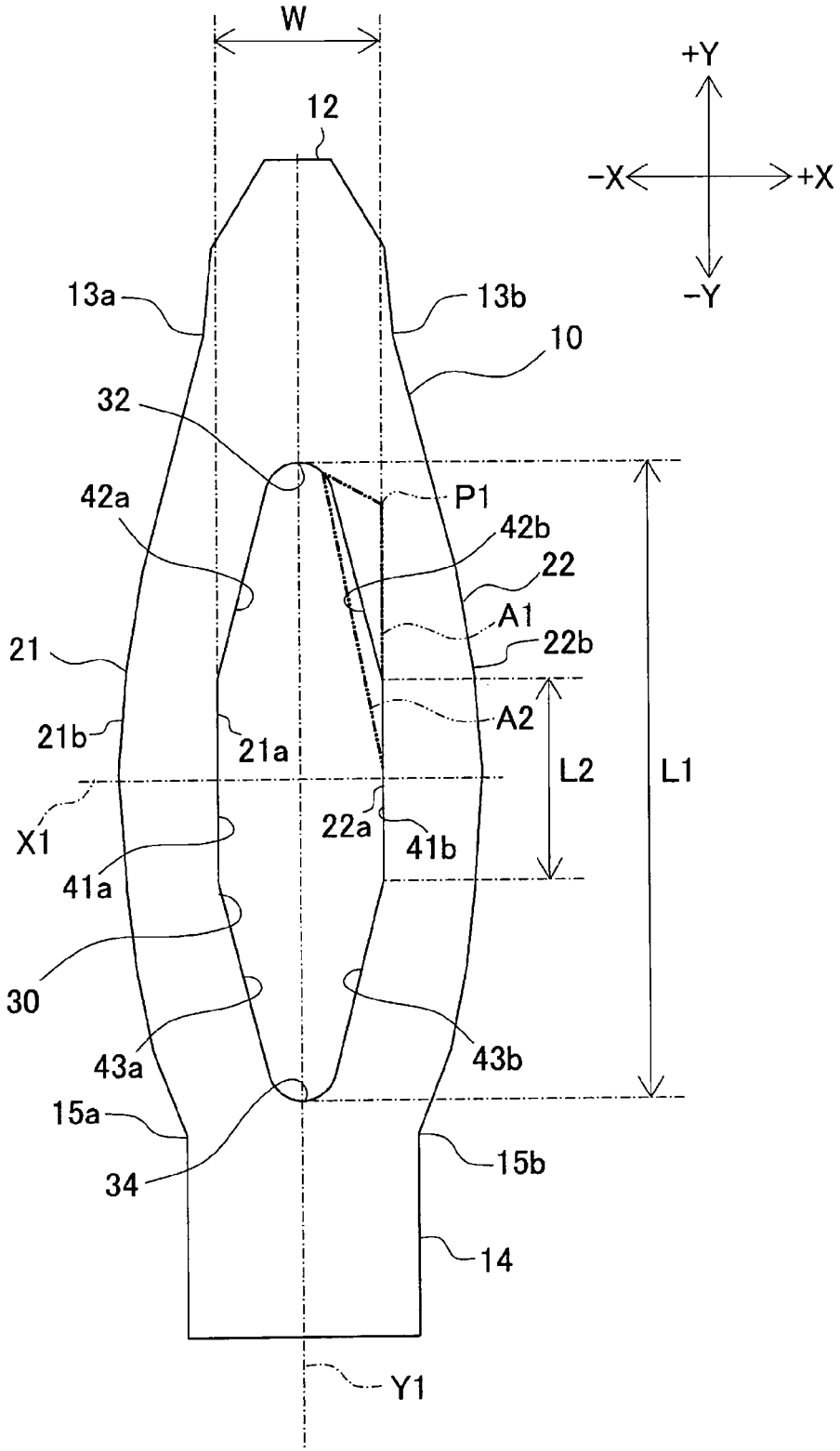
FIG. 1 is a plan view showing an example of a press-fit terminal according to a first embodiment of the present disclosure.
Figure 2:
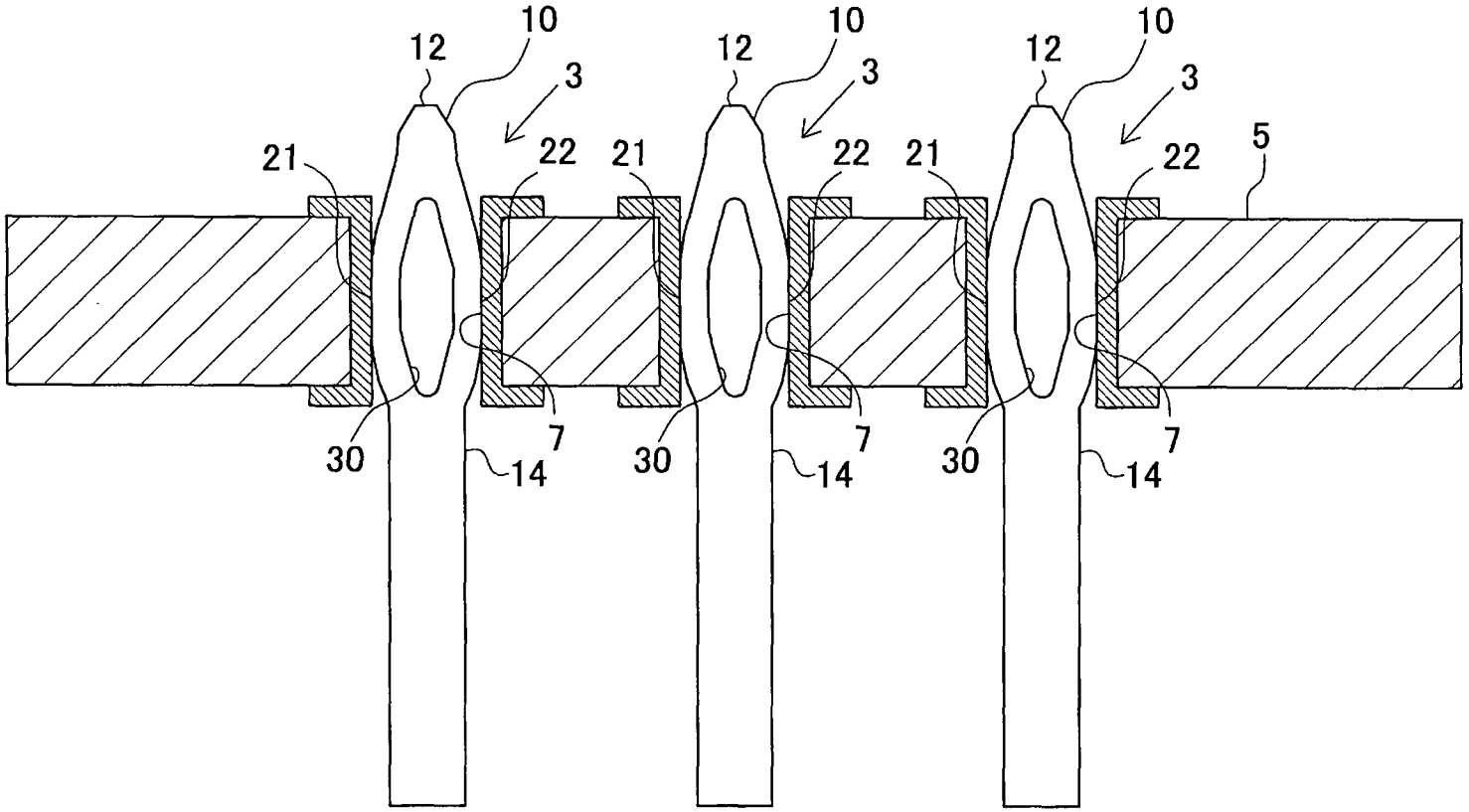
FIG. 2 is a cross-sectional view showing a connection structure of the press-fit terminal shown in FIG. 1 inserted in a through hole.
Figure 3:
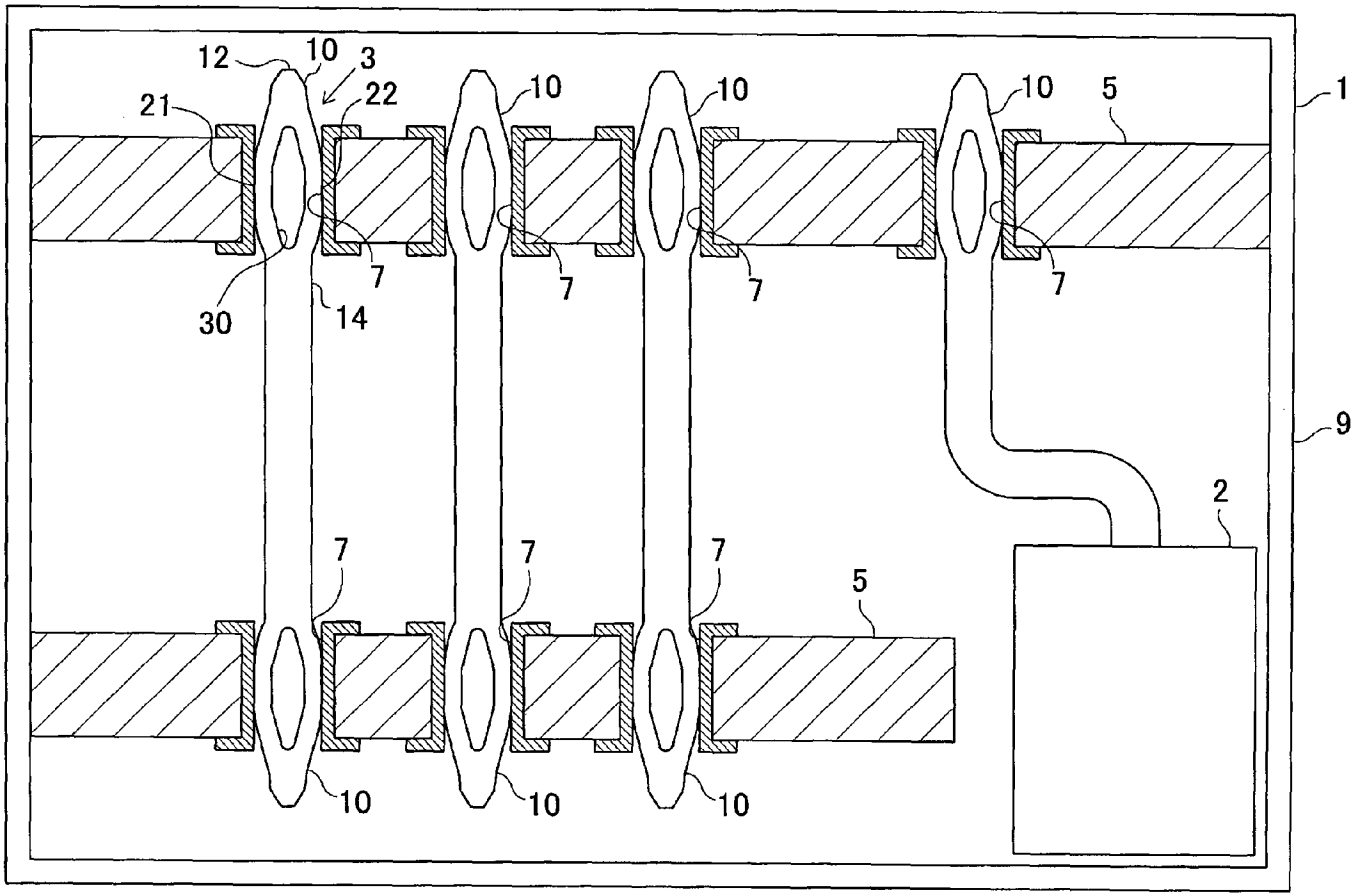
FIG. 3 is a sectional view showing an electronic device including the press-fit terminal shown in FIG. 1.

As follows, a first embodiment of the present disclosure will be described with reference to drawings. FIG. 1 shows a press-fit terminal 10. As shown in FIG. 2, the press-fit terminal 10 is connected to, for example, a through hole 7 of a circuit board 5. As shown in FIG. 3, the press-fit terminal 10 is, for example, a part an electronic device 1.

As shown in FIG. 1, the press-fit terminal 10 is, as a whole, in an elongated shape and has a tip end 12 on one end side in the longitudinal direction. The press-fit terminal 10 has a base end 14 on the opposite side (base end side) from the tip end 12 in the longitudinal direction. The base end 14 connects a first conductive portion 21 with a second conductive portion 22 integrally with each other, as described later. In the present disclosure, the longitudinal direction of the press-fit terminal 10 in the elongated shape may correspond to a predetermined direction. The electric conduction material is in an elongated plate shape. The press-fit terminal 10 is formed by perforating an intermediate position of the electric conduction material in the longitudinal direction to form an elongated opening 30.

In the following description, as shown in FIG. 1, the longitudinal direction of the press-fit terminal 10 corresponds to a Y-axis direction, and the width direction of the press-fit terminal 10 corresponds to an X-axis direction. The width direction of the press-fit terminal 10 corresponds to a direction perpendicular to both the longitudinal direction and the thickness direction of the press-fit terminal 10.

The press-fit terminal 10 is formed from a base material, which is in an elongated plate shape. The press-fit terminal 10 is formed by, for example, removing a portion of the base material close to its center by a machining work, such as punching, to be in the shape shown in FIG. 1. The press-fit terminal 10 is plated on its surface to have a plated layer. In the example of FIG. 1, the press-fit terminal 10 is, as a whole, in the elongated shape. The press-fit terminal 10 has the tip end 12 on the one side in the longitudinal direction and has the base end 14 on the other side in the longitudinal direction.

The tip end 12 has a portion close to the press-fit terminal 10, and the portion is in a tapered shape in which the width decreases from a one end portion 32 of the opening 30 toward the tip end 12. Specifically, the press-fit terminal 10 has a portion, which extends from a position around a longitudinal center position X1 of the opening 30 to predetermined positions 13*a* and 13*b* on the tip end side beyond the one end portion 32 of the opening 30, and the position is formed such that the width (terminal width) continuously decreases toward the tip end 12. In the present region, which is from the portion close to the longitudinal center position X1 to the predetermined positions 13*a* and 13*b*, each of the side portions of the press-fit terminal 10 is in a smooth curved shape, which is convex on the outside. The press-fit terminal 10 further has a portion, which is on the side of the tip end 12 from the predetermined positions 13*a* and 13*b*, and the width of the portion decreases continuously or stepwisely toward the tip end 12.

The press-fit terminal 10 further has a portion close to the base end 14, and the portion has a region, which is from an other end portion 34 of the opening 30 to the predetermined positions 15*a* and 15*b*. In this region, the width decreases as being away from the tip end 12. Specifically, the press-fit terminal 10 has a portion, which extends from a position around the longitudinal center position X1 of the opening 30 to predetermined positions 15*a* and 15*b* on the base end side beyond the other end portion 34. This position is formed such that the width continuously decreases as being away from the tip end 12. In the present region, which is from the portion close to the longitudinal center position X1 to the predetermined positions 15*a* and 15*b*, each of the side portions of the press-fit terminal 10 is in a smooth curved shape, which is convex on the outside. The press-fit terminal 10 has a portion on the base end side, the portion extending from the predetermined positions 15*a* and 15*b* in a direction away from the tip end 12. In this portion, the width is substantially constant for a predetermined length in the longitudinal direction (Y-axis direction).

In the present configuration, the first conductive portion 21 and the second conductive portion 22 are arranged in parallel with each other to connect the portion on the side of the tip end 12 with the portion on the side of the base end 14. The first conductive portion 21 functions as a first contact portion, which contacts with a wall defining the through hole 7 (FIGS. 2 and 3), when the press-fit terminal 10 is inserted in the through hole 7. The first conductive portion 21 is in a slightly curved shape and extends from the side of the tip end 12 to the side of the base end 14. The second conductive portion 22 functions as a second contact portion, which contacts with the wall defining the through hole 7 (FIGS. 2 and 3), when the press-fit terminal 10 is inserted in the through hole 7. The second conductive portion 22 is in a slightly curved shape and extends from the side of the tip end 12 to the side of the base end 14. The first conductive portion 21 on one side is in a convex shape and curved outward to be away from the second conductive portion 22 in the width direction. The second conductive portion 22 on the other side is in a convex shape and curved outward to be away from the first conductive portion 21 in the width direction. The first conductive portion 21 and the second conductive portion 22 are connected with each other at a position close to the one end portion 32 and are further connected with each other at a position close to the other end portion 34.

Referring back to FIG. 1, the press-fit terminal 10 according to the present embodiment is line-symmetrical with respect to a widthwise center line Y1, as an axis of symmetry, when being planer-viewed. The first conductive portion 21 and the second conductive portion 22 are line-symmetrical to each other with respect to the center line Y1, as an axis of symmetry. The press-fit terminal 10 has, in the longitudinal direction (Y-axis direction), a region, which includes the first conductive portion 21 and the second conductive portion 22 to form the opening 30. This region has a largest width (terminal width) around a longitudinal center position shown by the dashed-dotted line X1 in the example of FIG. 1. The first conductive portion 21 gradually gets closer to the second conductive portion 22 to decrease the terminal width gradually from the center position X1 toward the one end portion 32. Similarly, on the side of the other end portion 34, the first conductive portion 21 also gradually gets closer to the second conductive portion 22 to decrease the terminal width gradually from the center position X1 toward the other end portion 34. The press-fit terminal 10 has the region including the first conductive portion 21 and the second conductive portion 22 to form the opening 30. In this region, the width (terminal width) of the press-fit terminal 10 is a distance between the side wall portion 21*b* of the first conductive portion 21 and a side wall portion 22*b* of the second conductive portion 22 in the width direction (X-axis direction). The terminal width of the press-fit terminal 10 in the region is determined according to the position in the longitudinal direction (Y-axis direction).

The press-fit terminal 10 has the opening 30 around the longitudinal center portion. The opening 30 is a clearance (gap) formed between the first conductive portion 21 and the second conductive portion 22. The opening 30 is a through hole formed between the tip end 12 and the base end 14. More specifically, the opening 30 is a slit elongated in the longitudinal direction (Y-axis direction). The opening 30 is defined by a sidewall portion 21*a* of the first conductive portion 21 on the side of the second conductive portion 22 and a sidewall portion 22*a* of the second conductive portion 22 on the side of the first conductive portion 21. The sidewall portions 21*a* and 22*a* form inner wall portions defining the opening 30 (through hole). The sidewall portions 21*a* and 22*a* have inner circumferential peripheries defining the opening 30 as the through hole. The opening 30 extends through the press-fit terminal 10 in the thickness direction of the press-fit terminal 10.

The inner wall portion of the opening 30 includes a pair of first linear portions 41*a* and 41*b*, a pair of second linear portions 42*a* and 42*b*, and a pair of third linear portions 43*a* and 43*b*, which are connected with each other. The opening 30 has the one end portion 32 on the side of the tip end 12 and the other end portion 34 on the side of the base end 14. The pair of first linear portions 41*a* and 41*b* is distant from both the one end portion 32 and the other end portion 34 and is defined by the sidewall portion 21*a* of the first conductive portion 21 and a sidewall portion 21*b* of the second conductive portion 22, respectively. The pair of first linear portions 41*a* and 41*b* is each in a straight liner shape to extend along the predetermined direction, which corresponds to the Y-axis direction or the longitudinal direction.

In the example of FIG. 1, the pair of first linear portions 41*a* and 41*b* is exactly in parallel with each other or substantially in parallel with each other when being planar-viewed as shown in FIG. 1. The press-fit terminal 10 has, in the longitudinal direction (Y-axis direction), the region having the pair of first linear portions 41*a* and 41*b*. In this region, an opening width of the opening 30 is substantially constant. That is, in this region, the distance between the pair of first linear portions 41*a* and 41*b* is substantially constant. In the example of FIG. 1, the region, in which the pair of first linear portions 41*a* and 41*b* is formed, is at a position, in the longitudinal direction (Y-axis direction), close to the longitudinal center position X1 of the opening 30. The region, in which the pair of first linear portions 41*a* and 41*b* is formed, has a center position in the longitudinal direction (Y-axis direction). This center position, for example, substantially coincides with the longitudinal center position X1 of the opening 30. It is noted that, the configuration of the pair of first linear portions 41*a* and 41*b* is not limited to this example. The region, in which the pair of first linear portions 41*a* and 41*b* is formed, may be located relatively close to the one end portion 32 or may be located relatively close to the other end portion 34. In addition, in the example of FIG. 1, the outline of the pair of first linear portions 41*a* and 41*b* is exactly in parallel with or substantially in parallel with the longitudinal direction (Y-axis direction) when being planar-viewed, as shown in FIG. 1. It is further noted that, the pair of first linear portions 41*a* and 41*b* may not be exactly in parallel with the longitudinal direction (Y-axis direction). As described later, relative to the longitudinal direction (Y-axis direction), the pair of second linear portions 42*a* and 42*b* is inclined, and the pair of third linear portions 43*a* and 43*b* is also inclined. For example, one of or both the pair of first linear portions 41*a* and 41*b* may be slightly inclined relative to the longitudinal direction (Y-axis direction) by an inclination less than the inclination of the pair of second linear portions 42*a* and 42*b* and/or an inclination of the pair of third linear portions 43*a* and 43*b*.

The pair of second linear portions 42*a* and 42*b* is located on the side of the one end portion 32 relative to the pair of the first linear portions 41*a* and 41*b*. The pair of second linear portions 42*a* and 42*b* is defined by the sidewall portion 21*a* of the first conductive portion 21 and the sidewall portion 22*a* of the second conductive portion 22. The pair of second linear portions 42*a* and 42*b* is connected with the pair of first linear portions 41*a* and 41*b*, respectively. The pair of second linear portions 42*a* and 42*b* is each in a straight liner shape extending in a direction inclined relative to the longitudinal direction (Y-axis direction). The pair of second linear portions 42*a* and 42*b* gets closer to each other toward the one end portion 32. Specifically, each outline of the pair of second linear portions 42*a* and 42*b* is at an acute angle relative to the longitudinal direction (Y-axis direction) when being planar-viewed as shown in FIG. 1. In addition, extension lines of the outlines of the pair of second linear portions 42*a* and 42*b* are at an acute angle relative to each other when being planar-viewed as shown in FIG. 1. The pair of second linear portions 42*a* and 42*b* is connected with a curved portion, which is located on the side of the tip end 12 farther than the pair of second linear portions 42*a* and 42*b*. The curved portion is in a concaved shape and is recessed toward the tip end 12. This curved portion has the one end portion 32 at a position closest to the tip end 12. The one end portion 32 is an end of the opening 30 on the side of the tip end.

The pair of third linear portions 43*a* and 43*b* is located on the side of the other end portion 34 relative to the pair of the first linear portions 41*a* and 41*b*. The pair of third linear portions 43*a* and 43*b* is defined by the sidewall portion 21*a* of the first conductive portion 21 and the sidewall portion 22*a* of the second conductive portion 22. The pair of third linear portions 43*a* and 43*b* is connected with the pair of first linear portions 41*a* and 41*b*, respectively. The pair of third linear portions 43*a* and 43*b* is each in a straight liner shape extending in a direction inclined relative to the longitudinal direction (Y-axis direction). The pair of third linear portions 43*a* and 43*b* gets closer to each other toward the other end portion 34. Specifically, each outline of the pair of third linear portions 43*a* and 43*b* is at an acute angle relative to the longitudinal direction (Y-axis direction) when being planar-viewed as shown in FIG. 1. In addition, extension lines of the outlines of the pair of third linear portions 43*a* and 43*b* are at an acute angle relative to each other when being planar-viewed as shown in FIG. 1. The pair of third linear portions 43*a* and 43*b* is connected with a curved portion, which is located on the side of the base end 14 farther than the pair of third linear portions 43*a* and 43*b*. The curved portion is in a concaved shape and is recessed toward the base end 14. This curved portion has the other end portion 34 at a position closest to the base end 14. The other end portion 34 is located at a position most farther from the tip end 12. The other end portion 34 is an end of the opening 30 on the side of the base end.

The opening 30 has a length L1 in a predetermined direction. The first linear portions 41*a* and 41*b* have a length L2 in the predetermined direction. A ratio L1/L2 between the length L1 and the length L2 is set in a range between 4 and 9. Specifically, the predetermined direction corresponds to the direction in which the terminal, as a whole, extends from the base end 14 toward the tip end 12. In the example of FIG. 1, the predetermined direction corresponds to the longitudinal direction (Y-axis direction) of the press-fit terminal 10. The length L1 is the distance between the one end portion 32 and the other end portion 34 in the opening 30 along the longitudinal direction (Y-axis direction) of the press-fit terminal 10. In addition, in the example of FIG. 1, the pair of first linear portions 41*a* and 41*b* is substantially at the same position in the longitudinal direction (Y-axis direction). In addition, both the pair of first linear portions 41*a* and 41*b* has the lengths L2, equivalent to each other, along the longitudinal direction (Y-axis direction). The ratio L1/L2 between the length L1 of the opening 30 and the length L2 of the opening 30 is set in the range between 4 and 9.

The region of the first linear portion 41*a* and the region of the first linear portion 41*b* may differ slightly from each other in the longitudinal direction (Y-axis direction). In this case, the length of the region of the first linear portion 41*a* and the length of the region of the first linear portion 41*b* in the longitudinal direction (Y-axis direction) correspond to the lengths L2, respectively. Even in this case, the ratio L1/L2 may be desirably in the range between 4 and 9. Furthermore, the length of the first linear portion 41*a* and the length of the first linear portion 41*b* may be also desirably set such that the ratio is in the range. For example, the first linear portion 41*a* may have the length L21, and in this case, the ratio between the length L21 and the length L1 in the opening 30 may be set desirably such that the ratio of L1/L21 is within the range between 4 and 9. In addition, the first linear portion 41*b* may have the length L22, and in this case, the ratio between the length L22 and the length L1 in the opening 30 may be set desirably such that the ratio of L1/L22 is within the range between 4 and 9.

As shown in FIG. 6, the press-fit terminal 10 is formed of an electricity conductive material including a base material 51 covered with, for example, a Ni (nickel) plated layer 52. The base material 51 may be formed of, for example, a phosphor bronze. The nickel plated layer 52 has an upper layer (surface side), which is further covered with a Sn (tin) plated layer 53. The Ni plated layer 52 has a thickness T1, which is, for example, greater than 0 and less than or equal to 1.0 micrometer. The thickness T1 of the Ni plated layer 52 may be desirably in a range between, for example, 0.2 micrometer and 0.5 micrometer. It is noted that, FIG. 6 is a schematic view showing the layers, and the thickness of the base material 51 may be set to various values.

Subsequently, an attachment structure including the press-fit terminal 10, which is attached to a through hole, will be described. FIG. 2 shows a connection structure 3 including the press-fit terminals 10, as described above, and the circuit board 5, which has the through holes 7 each defined by an inner wall portion, which is in a tubular shape. Each press-fit terminal 10 is inserted at the tip end 12 into the corresponding through hole 7, which is formed in the circuit board 5, and is fitted to the through hole 7.

Before the press-fit terminal 10 is inserted into the through hole 7, the width of the portion of the press-fit terminal 10 on the side of the tip end relative to the opening 30 is less than the inner diameter of the through hole 7. In addition, before the press-fit terminal 10 is inserted into the through hole 7, the largest width of the portion of the press-fit terminal 10, which includes the first conductive portion 21 and the second conductive portion 22, is greater than the inner diameter of the through hole 7. When the press-fit terminal 10 having the present configuration is inserted into the through hole 7, the first conductive portion 21 and the second conductive portion 22 are bent on application of a bending force from the inner wall portion of the through hole 7. Thus, the press-fit terminal 10 is attached to the through hole 7 in a configuration in which the first conductive portion 21 and the second conductive portion 22 are in contact with the inner wall portion of the through hole 7.

Subsequently, the electronic device 1 employing the press-fit terminals 10 will be described. As shown in FIG. 3, the electronic device 1 is, for example, a vehicular electronic device such as an ECU. Similarly to the connection structure of FIG. 2, the electronic device 1 has a connection structure in which the press-fit terminals 10 (FIG. 1) are inserted in the circuit board 5 having the through holes 7. The electronic device 1 is configured with the press-fit terminals 10 and the circuit board 5 accommodated in a case 9. As shown in FIG. 3, the press-fit terminals 10 may be employed as, for example, connection members for electrically connecting the circuit board 5 with another component in the case 9. The press-fit terminals 10 may be employed as, for example, members located at connection positions of multiple circuit boards 5 and connected with the multiple circuit boards 5, respectively. The press-fit terminals 10 may be employed at, for example, connection positions at which a cable extending from the electronic component 9 is connected with the circuit board 5. The electronic device 1 is not limited to a specific device. The press-fit terminal(s) 10 may be employed in various vehicular electronic devices employing, for example, a press-fit terminal(s). The press-fit terminal(s) 10 may be employed in various vehicular electronic devices configured to employ, for example, a press-fit terminal(s), regardless of a size, a configuration, a function, and/or the like.

As described above, the configuration of the present embodiment has the pair of first linear portions (41*a*, 41*b*), which is located at the position on the center site of the opening (30), the first linear portions (41*a*, 41*b*) being in straight liner shapes to extend in predetermined directions. In addition, the opening (30) has a pair of second linear portions (42*a*, 42*b*) at the position on the side of the one end portion (32). The second linear portions (42*a*, 42*b*) are in straight liner shapes extending in directions inclined relative to a predetermined direction. A distance between the second linear portions (42*a*, 42*b*) decreases toward the one end portion (32). In addition, the opening (30) has a pair of third linear portions (43*a*, 43*b*) at the position on the side of the other end portion (34). The third linear portions (43*a*, 43*b*) are in straight liner shapes extending in directions inclined relative to the predetermined direction. A distance between the third linear portions (43*a*, 43*b*) decreases toward the other end portion (34).

In the present configuration, the opening has the pair of second linear portions, which has the width gradually decreasing toward the one end portion. The present configuration enables to secure large widths of the first conductive portion and the second conductive portion at the positions of the first linear portion and the second linear portion, compared with a configuration in which portions, which are in curved shapes being convex outward, are formed instead of the second linear portions. Similarly, in the present configuration, the opening has the pair of third linear portions, which has the width gradually decreasing toward the other end portion. The present configuration enables to secure large widths of the first conductive portion and the third conductive portion at the positions of the first linear portion and the second linear portion, compared with a configuration in which portions, which are in curved shapes being convex outward, are formed instead of the third linear portions. Therefore, even when a high contact load is applied on, the first conductive portion and the second conductive portion are restricted from causing strain on the side of the one end portion of the opening and on the side of the other end portion of the opening. Furthermore, the first conductive portion and the second conductive portion are restricted from causing a crack and/or the like, effectively. The present effect enables a design of the terminal to have a large margin to a strain, which corresponds to a fracture intensity limit, and to enhance a connection reliability of the terminal.

In the present example, the opening 30 has the length L1 in the predetermined direction. The first linear portions 41*a* and 41*b* have the length L2 in the predetermined direction. The ratio L1/L2 between the length L1 and the length L2 is set in the range between 4 and 9. It is assumed a configuration in which the ratio L1/L2, which is the ratio of the length L2 to the length L1, is less than 4. In the present assumed configuration, the length L2 of the first linear portions 41*a* and 41*b* is large relative to the length L1. In the assumed configuration, as shown by a two-dot-chain-line A1 in FIG. 1, the ends of the first linear portions 41*a* and 41*b*, one of which is shown by P1 in FIG. 1, are excessively close to the one end portion 32 or the other end portion 34. Consequently, a fulcrum portion close to the one end portion 32 or the other end portion 34 becomes excessively thin. It is further assumed a configuration in which the largest width of the terminal at the position of the first conductive portion 21 and the second conductive portion 22 is constant in relation to the through hole. In the assumed configuration, in a case where the opening width W (FIG. 1) is enlarged to suppress the contact load, the width of the fulcrum portion of the first linear portions 41*a* and 41*b*, which is close to the one end portion 32 or the other end portion 34, may become excessively small. Consequently, in the assumed configuration, stain may excessively increase. In consideration of these issues, it may be desirable to set the ratio L1/L2 to 4 or more.

To the contrary, it is assumed a configuration in which the ratio L1/L2, which is the ratio of the length L2 to the length L1, is greater than 9. In the present assumed configuration, the length L2 of the first linear portions 41*a* and 41*b* is small relative to the length L1. In the assumed configuration, as shown by a two-dot-chain-line A2 in FIG. 1, the first linear portions 41*a* and 41*b* become thick relatively. In the assumed configuration, in a case where the opening width W is enlarged to suppress the contact load, the position of the two-dot-chain-line A2 shown in FIG. 1 is shifted, as a whole, outward in the width direction. Therefore, in this case, the fulcrum portion of the first linear portions 41*a* and 41*b* close to the one end portion 32 or the other end portion 34 becomes thin. That is, even in this case, the width of the fulcrum portion close to the one end portion 32 or the other end portion 34 becomes excessively small. Consequently, strain is enlarged in the assumed configuration. In consideration of these issues, it may be desirable to set the ratio L1/L2 to 9 or less.

As follows, an experimental result, which further supports the numeric range, will be described. FIG. 4 shows a graph showing an example of a maximum strain (plastic strain) caused in the press-fit terminal 10 of FIG. 1, in a case where the ratio L1/L2 is changed to each value. It is clear from FIG. 4 that, in the range in which the ratio L1/L2 is between 4 and 9, the maximum strains (plastic strain) caused in the press-fit terminal 10 are small values less than 10.5. To the contrary, in a range in which the ratio L1/L2 is out of the range between 4 and 9, the maximum strains (plastic strain) caused in the press-fit terminal 10 are large values greater than 12.5. In consideration of these issues, it may be desirable that the ratio L1/L2 is in the range between 4 and 9.

The electricity conductive material employed in the present embodiment includes the base material 51, which is covered with at least the Ni plated layer 52. In addition, the thickness of the Ni plated layer 52 is set to 1.0 micrometer or less. As follows, an experimental result, which supports the numeric range, will be described. FIG. 5 is a view showing the experimental result acquired by inserting the press-fit terminal 10 in the shape shown in FIG. 1 into the through hole and fitted to the through hole. In the experiment, the thickness of the Ni plated layer 52 is set to 3.0 micrometers, 1.0 micrometer, or 0.5 micrometer, and in each of the thicknesses of the Ni plated layer 52, the ratio L1/L2 is set to each of the values.

In the view of FIG. 5, X represents a case where a crack occurs in the terminal, and O represents a case where a crack does not occur in the terminal. According to the experimental result shown in FIG. 5, in a case where the thickness of the Ni plated layer 52 exceeds 1.0, specifically, in a case where the thickness is 3.0 micrometers (μm) in FIG. 5, crack occurs in the terminal when the ratio L1/L2 is any one of the values between 3 and 10. In addition, in a case where the thickness of the Ni plated layer 52 is equal to or less than 1.0 micrometers, specifically, in cases where the thickness is 1.0 micrometers (μm) or 0.5 micrometers (μm) in FIG. 5, crack was not confirmed when the ratio L1/L2 is in the range between 4 and 9. Therefore, according to the experimental result, it may be desirable that the ratio L1/L2 is in the range between 4 and 9. Furthermore, it may be desirable that the thickness of the Ni plated layer 52 is 1.0 micrometer or less.

Other Embodiment

The present disclosure is not limited to the embodiment in the above description and drawings. The present disclosure may incorporate, for example, the following embodiments.

In the example of the above-described embodiment, the Ni plated layer 52 is formed on the upper side of the base material 51. It is noted that, the Ni plated layer 52 may not be formed. For example, the base material 51 may be covered with the Sn plated layer 53, without the Ni plated layer 52.

In the example of the above-described embodiment, the Sn plated layer 53 is formed on the upper side of the Ni plated layer 52. Alternatively, for example, the upper side of the Ni plated layer 52 may be covered with a Cu—Sn alloy layer and/or the like. Alternatively, the upper side of the Ni plated layer 52 may be covered with a plated layer other than the above-exemplified materials.

In the example of the above-described embodiment, a phosphor bronze is employed as the base material 51. It is noted that, a metallic material, which is other than a phosphor bronze and is plastically deformable, may be employed as the base material 51.

According to the present disclosure, the press-fit terminal (10) is formed of the electricity conductive material and extended in the predetermined direction. The press-fit terminal (10) includes the tip end (12), which is located on the one side relative to the predetermined direction, the base end (14), which is located on the other side relative to the predetermined direction, the first conductive portion (21), which extends from the side of the tip end (12) toward the base end (14), and the second conductive portion (22), which extends from the side of the tip end (12) toward the base end (14). The second conductive portion (22) is connected with the first conductive portion (21) on the side of the tip end (12) and on the side of the base end (14). The tip end (12) and the base end (14) therebetween define the opening (30), which is the through hole passing through the portion between the first conductive portion (21) and the second conductive portion (22).

The opening (30) includes the pair of first linear portions (41*a*, 41*b*), the pair of second linear portions (42*a*, 42*b*), and the pair of third linear portions (43*a*, 43*b*). The pair of first linear portions (41*a*, 41*b*) is in the straight liner shapes extending in the predetermined directions, respectively. The pair of first linear portions (41*a*, 41 *b*) is defined by the sidewall portion (21*a*) of the first conductive portion (21) and the sidewall portion (22*a*) of the second conductive portion (22). The pair of first linear portions (41*a*, 41 *b*) is distant from both the one end portion (32) of the opening (30) on the side of the tip end (12) and the other end portion (34) of the opening (30) on the side of the base end (14). The pair of second linear portions (42*a*, 42*b*) is in straight liner shapes extending in the inclined directions, respectively, relative to the predetermined direction. The pair of second linear portions (42*a*, 42*b*) is defined by the sidewall portion (21*a*) of the first conductive portion (21) and the sidewall portion (22*a*) of the second conductive portion (22). The pair of second linear portions (42*a*, 42*b*) is located on the side of the one end portion (32) relative to the pair of first linear portions (41*a*, 41*b*). The distance between the pair of second linear portions (42*a*, 42*b*) decreases toward the one end portion (32). The pair of third linear portions (43*a*, 43*b*) is in straight liner shapes extending in inclined directions, respectively, relative to the predetermined direction. The pair of third linear portions (43*a*, 43*b*) is defined by the sidewall portion (21*a*) of the first conductive portion (21) and the sidewall portion (22*a*) of the second conductive portion (22). The pair of third linear portions (43*a*, 43*b*) is located on the side of the other end portion (34) relative to the pair of first linear portions (41*a*, 41 *b*). The distance between the pair of third linear portions (43*a*, 43*b*) decreases toward the other end portion (34).

In the present configuration, the opening (30) has the pair of the first linear portions (41*a*, 41*b*) on the side of the center position. The pair of the first linear portions (41*a*, 41*b*) is in the straight liner shapes and extends in the predetermined directions, respectively. The opening (30) further has the pair of second linear portions (42*a*, 42*b*). The pair of second linear portions (42*a*, 42*b*) is located on the side of the one end portion (32). The pair of second linear portions (42*a*, 42*b*) is in straight liner shapes and extends in the inclined directions, respectively, relative to the predetermined direction. The distance between the pair of second linear portions (42*a*, 42*b*) decreases toward the one end portion (32). The opening (30) has the pair of third linear portions (43*a*, 43*b*). The pair of third linear portions (43*a*, 43*b*) is located on the side of the other end portion (34). The pair of third linear portions (43*a*, 43*b*) is in straight liner shapes and extends in the inclined directions, respectively, relative to the predetermined direction. The distance between the pair of third linear portions (43*a*, 43*b*) decreases toward the other end portion (34).

In the present configuration, the pair of second linear portions has the width, which decreases gradually toward the one end portion of the opening. The present configuration enables to secure the width between the first conductive portion and the second conductive portion widely at the position of the second linear portions, compared with a configuration in which the second linear portions are each formed in a curved ellipse shape being convex outward. Similarly, in the present configuration, the pair of third linear portions has the width, which decreases gradually toward the other end portion of the opening. The present configuration enables to secure the width between the first conductive portion and the second conductive portion widely at the position of the third linear portions, compared with a configuration in which the third linear portions are each formed in a curved ellipse shape being convex outward. Therefore, even in a configuration in which the contact load is high, the first conductive portion and the second conductive portion are restricted from causing a strain on the side of the one end portion of the opening and on the side of the other end portion of the opening. Consequently, the first conductive portion and the second conductive portion can be restricted from causing a crack and/or the like, effectively.

It should be appreciated that while the processes of the embodiments of the present disclosure have been described herein as including a specific sequence of steps, further alternative embodiments including various other sequences of these steps and/or additional steps not disclosed herein are intended to be within the steps of the present disclosure.

While the present disclosure has been described with reference to preferred embodiments thereof, it is to be understood that the disclosure is not limited to the preferred embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. A press-fit terminal formed of an electricity conductive material and extended in a predetermined direction, the press-fit terminal comprising:

a tip end located on one side relative to the predetermined direction;

a base end located on an other side relative to the predetermined direction;

a first conductive portion extending from a side of the tip end toward the base end; and a second conductive portion extending from a side of the tip end toward the base end, the second conductive portion being connected with the first conductive portion on the side of the tip end and on the side of the base end, wherein the tip end and the base end therebetween define an opening, which is a through hole passing through a portion between the first conductive portion and the second conductive portion, the opening includes a pair of first linear portions, a pair of second linear portions, and a pair of third linear portions, the pair of first linear portions is in straight liner shapes extending in predetermined directions, respectively, the pair of first linear portions is defined by a sidewall portion of the first conductive portion and a sidewall portion of the second conductive portion, the pair of first linear portions is distant from both one end portion of the opening on the side of the tip end and an other end portion of the opening on the side of the base end, the pair of second linear portions is in straight liner shapes extending in inclined directions, respectively, relative to the predetermined direction, the pair of second linear portions is defined by the sidewall portion of the first conductive portion and the sidewall portion of the second conductive portion, the pair of second linear portions is located on a side of the one end portion relative to the pair of first linear portions, a distance between the pair of second linear portions decreases toward the one end portion, the pair of third linear portions is in straight liner shapes extending in inclined directions, respectively, relative to the predetermined direction, the pair of third linear portions is defined by the sidewall portion of the first conductive portion and the sidewall portion of the second conductive portion, the pair of third linear portions is located on a side of the other end portion relative to the pair of first linear portions, a distance between the pair of third linear portions decreases toward the other end portion, the opening has a length L1 in the predetermined direction, and the pair of first linear portions has a length L2, where a ratio L1/L2 between the length L1 and the length L2 is in a range between 4 and 9, the electricity conductive material includes a base material covered with at least a Ni plated layer, where the Ni plated layer has a thickness of 1.0 micrometer or less, and the first conductive portion on one side is in a convex shape and curved outward to be away from the second conductive portion in the width direction, and the second conductive portion on the other side is in a convex shape and curved outward to be away from the first conductive portion in the width direction.

2. A connection structure comprising:

the press-fit terminal according to claim 1; and a board having a contact wall defining a through hole, wherein both the first conductive portion and the second conductive portion are in contact with the contact wall when the press-fit terminal is attached to the through hole.

3. An electronic device comprising:

the press-fit terminal according to claim 1; and a circuit board having a through hole, which is configured to be inserted with the press-fit terminal.

* * * * *